US007204022B2

(12) United States Patent
Tsuda

(10) Patent No.: US 7,204,022 B2
(45) Date of Patent: Apr. 17, 2007

(54) SCISSORS-ACTION TOOL WITH ADJUSTABLE OPENING ANGLE

(75) Inventor: Hollan Akio Tsuda, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 318 days.

(21) Appl. No.: 10/794,245

(22) Filed: Mar. 5, 2004

(65) Prior Publication Data

US 2005/0193570 A1 Sep. 8, 2005

(51) Int. Cl.
*B26B 13/00* (2006.01)
*B26B 13/16* (2006.01)

(52) U.S. Cl. ..... 30/194; 81/408; 7/128

(58) Field of Classification Search ..... 30/194, 30/199, 320; 81/407, 408, 427.5; 7/128, 7/168

See application file for complete search history.

(56) References Cited

U.S. PATENT DOCUMENTS

| | | | |
|---|---|---|---|
| 70,718 | A | 11/1867 | Hoe |
| 159,134 | A | 1/1875 | Woodward |
| 188,777 | A | 3/1877 | Chester |
| 239,208 | A | 3/1881 | Whitmore |
| 310,439 | A | 1/1885 | Kamak |
| 464,405 | A | 12/1891 | Widmann |
| 471,562 | A | 3/1892 | Minnerly |
| 515,828 | A | 3/1894 | Hayden |
| 533,504 | A | 2/1895 | Sonnesen |
| 696,995 | A | 4/1902 | Moser |
| 716,623 | A | 12/1902 | Brouillette |
| 809,579 | A | 1/1906 | Pastore |
| 1,046,361 | A | 12/1912 | Wulff |
| 1,052,878 | A | 2/1913 | Atkeson |
| 1,268,558 | A | 6/1918 | Faix |
| 1,296,660 | A | 3/1919 | Hayden |
| 1,467,661 | A | 9/1923 | Undy |
| 1,828,121 | A | 10/1931 | Adam et al. |
| 2,126,699 | A | 8/1938 | Florian |
| 2,575,652 | A | 11/1951 | Bovee |
| 2,601,766 | A | 7/1952 | Riddell et al. |

(Continued)

FOREIGN PATENT DOCUMENTS

| | | |
|---|---|---|
| DE | 29556 | 12/1884 |

(Continued)

OTHER PUBLICATIONS

U.S. Appl. No. 10/892,925, Berg et al.

(Continued)

*Primary Examiner*—Boyer D. Ashley
*Assistant Examiner*—Sean Michalski
(74) *Attorney, Agent, or Firm*—Chernoff, Vilhauer, McClung & Stenzel, LLP

(57) ABSTRACT

A scissors-action tool whose blades or jaws are urged apart by a spring and which includes an adjustable member restricting opening movement to a limited blade or jaw separation angle during normal use of the tool, but allowing the blades or jaws to be opened to a wider angle when the adjustable member is moved to a rearward position. The adjustable member may be a rocker including an elongated hole permitting the rocker to be moved rearwardly from a normal position of engagement with a rocker pivot pin.

24 Claims, 7 Drawing Sheets

U.S. PATENT DOCUMENTS

| | | | | | |
|---|---|---|---|---|---|
| 2,847,889 | A | | 8/1958 | Cain | |
| 3,375,581 | A | * | 4/1968 | Knight | 30/248 |
| 3,422,532 | A | * | 1/1969 | Ballard | 30/252 |
| 4,238,862 | A | | 12/1980 | Leatherman | |
| 4,296,655 | A | * | 10/1981 | Tesoro | 81/405 |
| 4,429,460 | A | * | 2/1984 | Hill et al. | 30/90.1 |
| 4,888,869 | A | | 12/1989 | Leatherman | |
| 5,119,520 | A | * | 6/1992 | Finn | 7/127 |
| 5,142,721 | A | | 9/1992 | Sessions et al. | |
| 5,212,844 | A | | 5/1993 | Sessions et al. | |
| 5,400,451 | A | | 3/1995 | Furukawa | |
| 5,669,149 | A | | 9/1997 | Meitzler | |
| 5,743,582 | A | | 4/1998 | Rivera | |
| 5,745,997 | A | | 5/1998 | Berg et al. | |
| 5,946,752 | A | | 9/1999 | Parrish | |
| 5,978,993 | A | | 11/1999 | Rivera | |
| 5,979,959 | A | | 11/1999 | Rivera | |
| 6,047,426 | A | | 4/2000 | McIntosh et al. | |
| 6,098,225 | A | | 8/2000 | McIntosh et al. | |
| 6,282,997 | B1 | | 9/2001 | Frazer | |
| 6,293,018 | B1 | | 9/2001 | Rivera | |
| 6,408,522 | B2 | | 6/2002 | Rivera | |
| 6,450,071 | B2 | | 9/2002 | Berg et al. | |
| 6,474,202 | B2 | | 11/2002 | Frazer | |
| 6,574,870 | B1 | * | 6/2003 | Huang | 30/252 |
| 6,718,585 | B2 | | 4/2004 | McIntosh et al. | |
| 6,769,331 | B2 | * | 8/2004 | Berg et al. | 81/427.5 |

FOREIGN PATENT DOCUMENTS

| | | |
|---|---|---|
| DE | 145784 | 11/1903 |
| DE | 2322229 | 5/1974 |
| FR | 409943 | 3/1910 |
| IT | 521555 | 3/1955 |
| JP | 3041991 | 2/1991 |

OTHER PUBLICATIONS

RCE Fish Tail Holder, at least a early as 1990, 2 pages.
Sports Tools (Xuron Corp.) FF-1 Stainless Steel Fishing Combination Cutter/Pliers Tools, at least as early as 1993, 3 pages.
SOG "Paratool" multipurpose tool, at least as early as 1993, 2 pages.
Slip 'n Snip Collapsible Scissors, at least as early as Nov. 29, 1994, 1 page.
Aitor Pocket Tool, at least as early as Nov. 29, 1994, 11 pages.
Folding Scissors, at least as early as Nov. 29, 1994, 1 page.
Gerber Multi-Plier Multipurpose Tool, at least as early as 1995, 2 pages.
Leatherman Tool Group, Inc., "The Original Leatherman PST II", at least as early as Jul. 1995, 2 pages.
E-Bay Advertisment, "Early 1900s Folding Fisherman's Tool MT," Item No. 2153119094, at least as early as Jan. 13, 2003, 6 pages.

* cited by examiner

SCISSORS-ACTION TOOL WITH ADJUSTABLE OPENING ANGLE

BACKGROUND OF THE INVENTION

The present application relates to scissors-action tools, and in particular to such a tool in which the blades are normally able to open to a restricted angle during use, and in which a simple adjustment permits the blades to be opened to a greater angle than normal.

Berg, et al., U.S. Pat. No. 5,745,997 discloses scissors including folding handles. A spring urges scissors blades apart from each other to a position of readiness for a cutting stroke so that it is unnecessary to include a loop in the handles of the scissors, and the scissors can therefore be folded to a relatively small size when not in use. The scissors include rockers that prevent the blades from opening beyond an angle at which the handles can be manipulated easily, but this angle is less than 90 degrees and does not expose the entire edge of each blade to be resharpened, so long as the blades are held together by their pivot joint. With the scissors blades held to a limited angle, however the handles can be folded by overcoming the force of a spring pressing on a cam to keep each handle extended.

Berg et al. also disclose scissors with non-folding handles that can be moved to a stowed position in the handle of a folding multipurpose hand tool. In such scissors a rocker can be rotated to a position providing clearance to open the scissors blades to about 90 degrees to facilitate resharpening.

Hayden, U.S. Pat. No. 1,296,660 shows scissors including a thumbscrew attached to one handle and adjustable to limit the blades to being opened to an acute angle or to allow them to be opened to at least 90 degrees.

Frazer, U.S. Pat. No. 6,282,997 discloses small scissors included in a folding multipurpose tool. The blades of the scissors are urged apart from each other by a spring which has an end engaged in a slot defined in one of the handles. The slot limits the angle to which the blades can be opened apart from each other during normal use, but the end of the spring can be removed from the slot to permit the blades to be opened farther, to an angle which provides access to the edges of the scissors to permit them to be sharpened readily.

What is desired, then, is a scissors-action tool in which blades or pivoted jaws are urged open by a spring and normally are limited to a predetermined blade-separation angle, but in which a blade-separation limiting element can be moved to a second position, permitting the blades to be opened to a greater angle to facilitate maintenance of the tool such as resharpening cutting portions of scissors blades or shaping gripping faces of pliers jaws.

SUMMARY OF THE INVENTION

The present invention overcomes the aforementioned shortcoming of prior art spring-opened scissors-action tools, by providing a scissors-action tool in which a limiting device, when in its usual first or forward position, allows the handles and blades of the scissors-action tool to move through a predetermined, relatively small angle between a fully closed position and an open position preparatory for a working stroke. When it is necessary to resharpen edges or otherwise repair surfaces of the blades or jaws of such a tool, however, the limiting member or stop can be moved to a second position allowing movement of the blades or jaws with respect to each other to a wider blade-opening angle so that, for example, a cutting portion of each blade can be sharpened without interference by the other blade.

In a tool which is one preferred embodiment of the invention, each blade of such a scissors-action tool has attached thereto a respective handle which can be pivoted, between an extended, operational, position and a folded position with respect to the blade, and a spring carried in one handle urges a rocker against the opposite blade, the blade associated with the other handle, thus urging the blades apart from each other in a blade-opening direction. The same rocker also acts on the opposite blade so as to prevent the blades from being opened beyond an angle at which the handles are located close enough to each other to be squeezed together easily to use the tool, when the rocker is in its forward, or normal operational, position.

The rocker in such a tool can also be moved to a second, rearward, or retracted, position providing additional clearance between the rocker and the opposite blade, allowing the blades to be moved apart from each other in the blade-opening direction to a blade separation angle larger than that to which the blades can be moved when the rocker is in its first, or normal operational, position.

In a tool which is one preferred embodiment of the invention, the blades of the scissors-action tool interact with the rocker to move the rocker back into its normal position as a result of moving the blades in a blade-closing direction, so that no tools are required to return the scissors-action tool to an operational configuration once the blades have been sharpened or repaired as required.

In a tool which is one preferred embodiment of the invention, such a rocker includes a slot defining both a first, or normal pivot axis for the rocker and also providing space allowing the rocker to be moved rearward with respect to a pivot pin to a second position of the rocker, in which the pivot pin is in a different place within the slot and the rocker rotates about a different pivot axis.

The foregoing and other features of the present invention will be more readily understood upon consideration of the following detailed description of the invention taken in conjunction with the accompanying drawings.

DETAILED DESCRIPTION OF THE PREFERRED EMBODIMENTS

Figure 1:
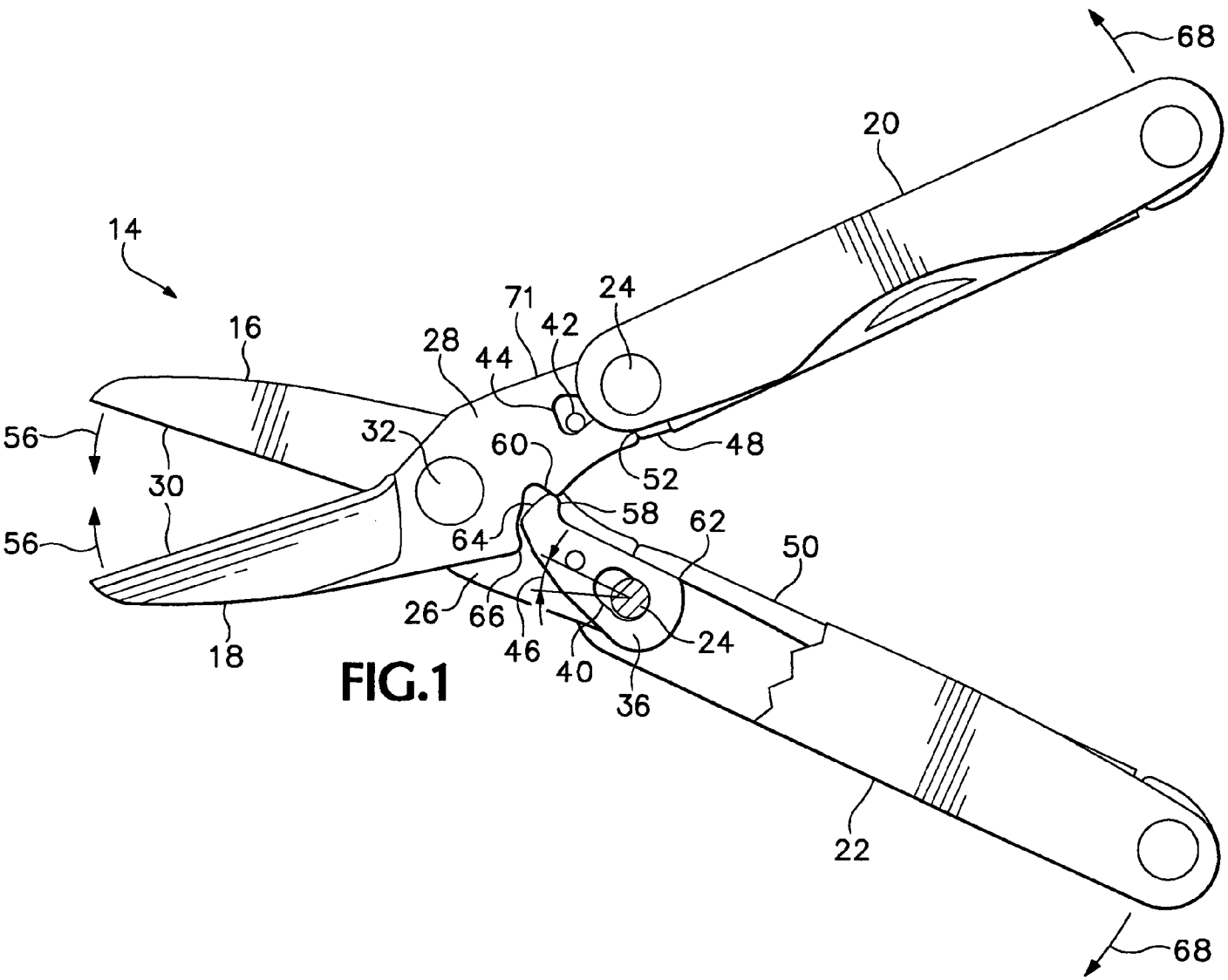
FIG. 1 is a partially cutaway side elevational view of a multipurpose folding tool including scissors embodying the present invention.
Figure 2:
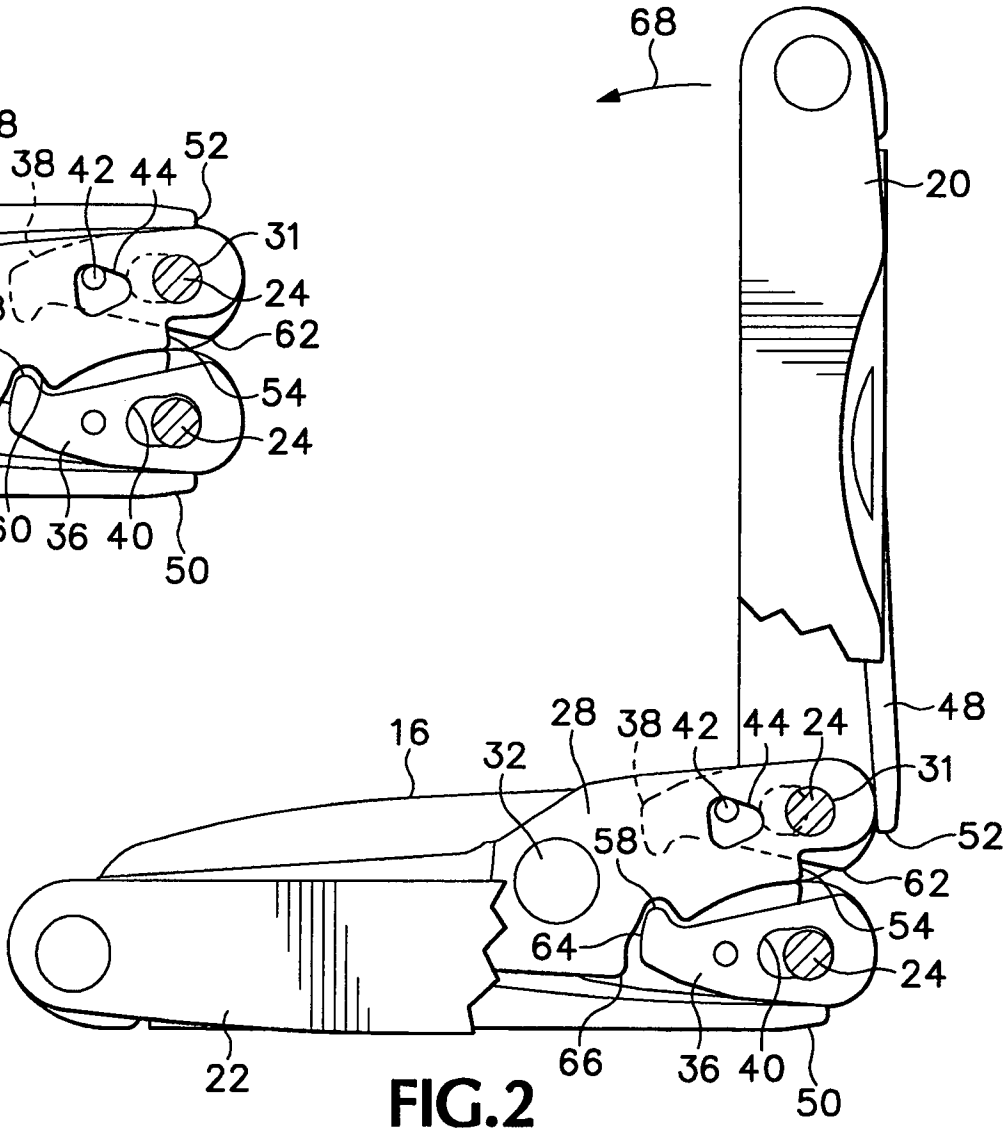
FIG. 2 is a partially cutaway side elevational view of the tool shown in FIG. 1, with the near side of each handle cut away to expose the scissors operating mechanisms incorporated in the tool, and showing one handle in a partially extended position.
Figure 3:
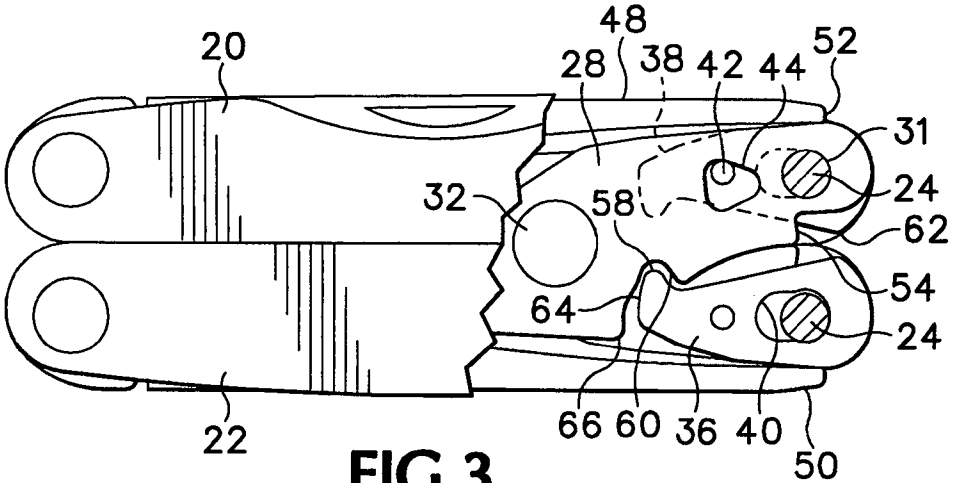
FIG. 3 is a view similar to FIG. 2 but showing the tool with the scissors and both handles in a compact, fully folded configuration.

Referring now to FIGS. 1–3 of the drawings, a multipurpose folding tool 14 which is one embodiment of the present invention includes a pair of folding scissors including a pair of first and second scissors blades 16, 18 attached respectively to a pair of handles 20, 22 that are movable to a folded configuration, as shown in FIG. 3. The first and second scissors blades 16, 18 are identical with each other but are given different reference numbers here to facilitate understanding of their interactions with each other. As shown in FIGS. 2 and 3, at one end of each handle 20, 22, a respective handle pivot pin 24 attaches each of the handles 20, 22 to a blade base 26 or 28 of a respective one of the blades 16, 18, each of which has a sharp-edged cutting portion 30. Each blade base 26, 28 includes an aperture 31 that fits snugly around the respective one of the handle pivot pins 24, allowing each handle to pivot. The blades 16, 18 are interconnected with each other by a scissors pivot joint 32, preferably a rivet located between the cutting portions 30 and the respective blade base 26 or 28, about which the scissors blades 16, 18 can pivot with respect to each other in scissors fashion. It will be understood that instead of scissors blades other scissors-action tool elements such as pliers jaws, wire cutter or wirestripper blades, or other jawlike members interconnected with each other through a pivot joint could be included in the tool 14. Descriptions of the mechanisms of the tool 14 as shown herein thus are applicable to such other tools including jaws or jawlike members instead of scissors blades. It will be understood, then, that the mechanisms described above could also be used in connection with other tools such as pliers including blades, jaws, or jawlike members interconnected by a pivot joint, and which it might be desired to separate at times by a larger-than-normal separation angle in order to sharpen cutting portions or to reshape other surfaces of such blades or jaws without disconnecting a pivot joint.

Preferably, each of a pair of identical rockers 36, 38 defines an elongated pivot hole, referred to herein as a slot 40, through which a respective one of the handle pivot pins 24 extends, permitting each of the rockers 36, 38 to pivot smoothly about the respective handle pivot pin 24, which thus defines a respective rocker pivot axis coinciding with the handle pivot axis. As shown in FIG. 1, each of the rockers 36 and 38 is in a forward, first, or normal operative position with respect to the respective handle pivot pin 24. If desired, the scissors could be constructed with only one rocker 36 or 38, but it is preferable to include both. In the embodiment of the tool shown herein, then, the rocker 36 is associated with and located alongside the first scissors blade 16 and the rocker 38 is associated with and located alongside the second scissors blade 18. Each handle pivot pin 24 is fitted to provide enough axial clearance on each side of the scissors blade 16 or 18 and the respective rocker 36 or 38 for the rocker to be free to move about the handle pivot pin 24 alongside the blade base 26 or 28.

Each rocker 36, 38 includes a connecting elements, which in the tool depicted is a laterally projecting pin 42, preferably formed by swaging the rocker. The pin 42 projects toward the adjacent blade base 26 or 28 and extends into an opening 44 in the blade base 26 or 28. The opening 44 is larger than the pin 42, and space surrounding the pin 42 in the opening 44 permits the rocker 36 or 38 to rotate about the handle pivot pin 24 through an angle 46 with respect to the blade base 26 or 28. The angle 46 thus is limited by the relationship between the pin 42 and the opening 44. For reasons that will be explained below, the opening 44 may be generally triangular, as shown in the drawings.

Mounted within each of the handles 20, 22 are a scissors blade spring 48, which acts as a jaw spring in a tool including jaws or jawlike members instead of scissors, and a rocker spring 50. As may be seen in FIGS. 2 and 3, these springs 48, 50 may be generally similar in shape and are located side by side within each handle 20 or 22. The springs 48, 50 extend in a cantilevered fashion, supported by the handle 20 or 22 so that a slender outer end portion of each spring presses with some force against the respective blade base 26 or 28 or rocker 36 or 38 with which it is related. By pressing against the adjacent surface of each blade base 26 or 28, each scissors blade spring 48 keeps the handle 20 or 22 in which it is mounted either in its folded position, as shown in FIG. 3, or in its fully extended position as both handles 20 and 22 are shown in FIG. 1. Moving a handle 20 or 22 away from one of those positions with respect to the associated scissors blade causes the blade base 26 or 28, acting as a cam against the blade spring 48, to increase the flexure of the blade spring.

When each handle 20 and 22 has been moved to its fully extended position with respect to the associated blade base 26 or 28, a tip 52 of the respective scissors blade spring 48 engages an abutment surface 54 on the respective blade base 26 or 28, preventing the handle 20 or 22 from pivoting further with respect to the blade base. Further force exerted in the same direction by the handle then moves the associated blade 16 or 18, so that movement of the handles 20 and 22 toward each other results in movement of the scissors blades 16 or 18 about the scissors pivot joint 32, moving cutting portions 30 of the scissors blades toward each other in a scissors blade closing direction as indicated by the arrows 56.

Each of the rockers 36, 38, includes a finger-like tip 58 which rests against a cam surface 60 on the margin of the blade base 26 or 28 of the opposite scissors blade. Thus the rocker spring 50 carried in the handle 22 presses against a cam lobe 62 of the rocker 36, urging the rocker to pivot in a clockwise direction around the handle pivot pin 24 as shown in FIGS. 1 and 4, so that the tip 58 of the rocker 36 presses against the cam 60 on the blade base 28 of the scissors blade 18 as shown in FIG. 1, urging the scissors blades to move in the blade-opening direction, until the pin 42 encounters the interior surface of the opening 44 in the adjacent blade base 28.

Figure 4:
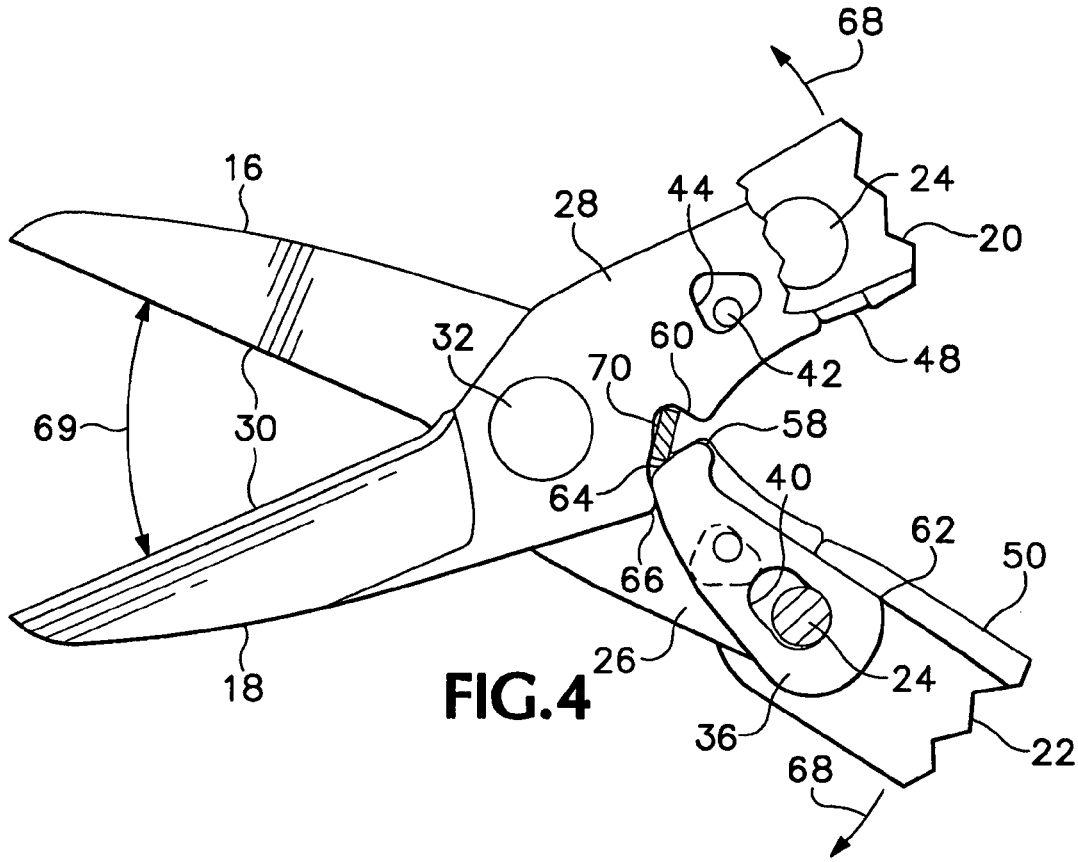
FIG. 4 is a partially cutaway view of a portion of the tool shown in FIG. 1, showing a rocker about to be moved toward a rearward position.

As the handles 20, 22 are separated further from one another and the blades 16, 18 are thus opened apart from each other, the outer end 64 of each rocker 36 or 38 encounters a heel 66 defined by the outer margin of the opposite blade 16 or 18, as shown in FIG. 4, preventing the blades from opening further apart from one another about the scissors pivot joint 32 beyond the acute blade separation angle 69 shown in FIG. 4, so long as at least one of the rockers 36 or 38 is in the first, or forward, position as shown in FIGS. 1–4 on the respective handle pin 24. This keeps the handles 20, 22 within a close enough distance from each other so that one can easily grasp both handles 20 and 22 and squeeze them toward each other to move the scissors blades 16, 18 in the blade-closing direction as a cutting stroke of the scissors.

The resulting limitation of the separation of the blades 16 and 18 from each other when the rockers 36 and 38 are in their first, or normal operational position as shown in FIG. 1 also facilitates pivoting the handles 20, 22 with respect to the blade bases 26, 28 of the scissors blades in a handle folding direction by moving the handles further in a blade-opening direction indicated by the arrows 68. As explained above, this pivoting, or folding, of the handles 20 and 22 requires each blade base 26 and 28 to act as a cam and to flex the associated scissors blade spring 48. The blade-blocking action of the outer end 64 of a rocker against the heel 66 of each blade 16 and 18, however, results in the blades being kept within the blade separation angle 69 from each other, so that each blade 16 or 18 interferes with easy access to the other for sharpening of the cutting portions 30.

Figure 5:
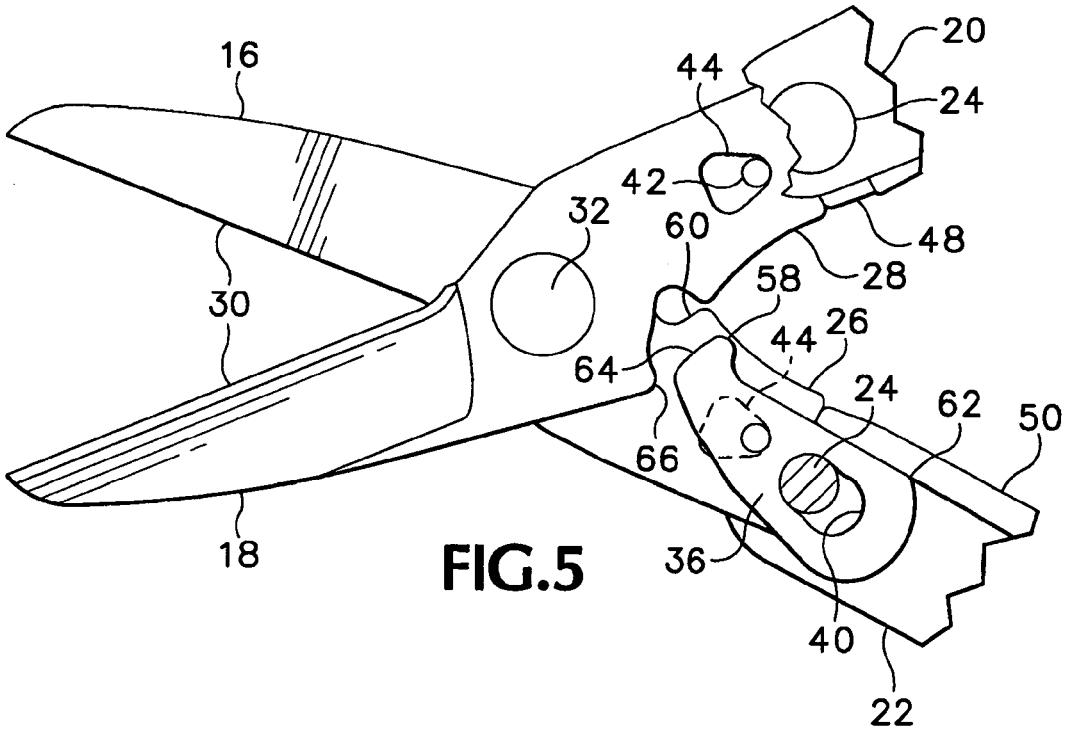
FIG. 5 is a view of the portion of a tool shown in FIG. 4 with its rockers in fully rearward positions and showing the resulting clearance between one rocker and the opposite scissors blade.
Figure 6:
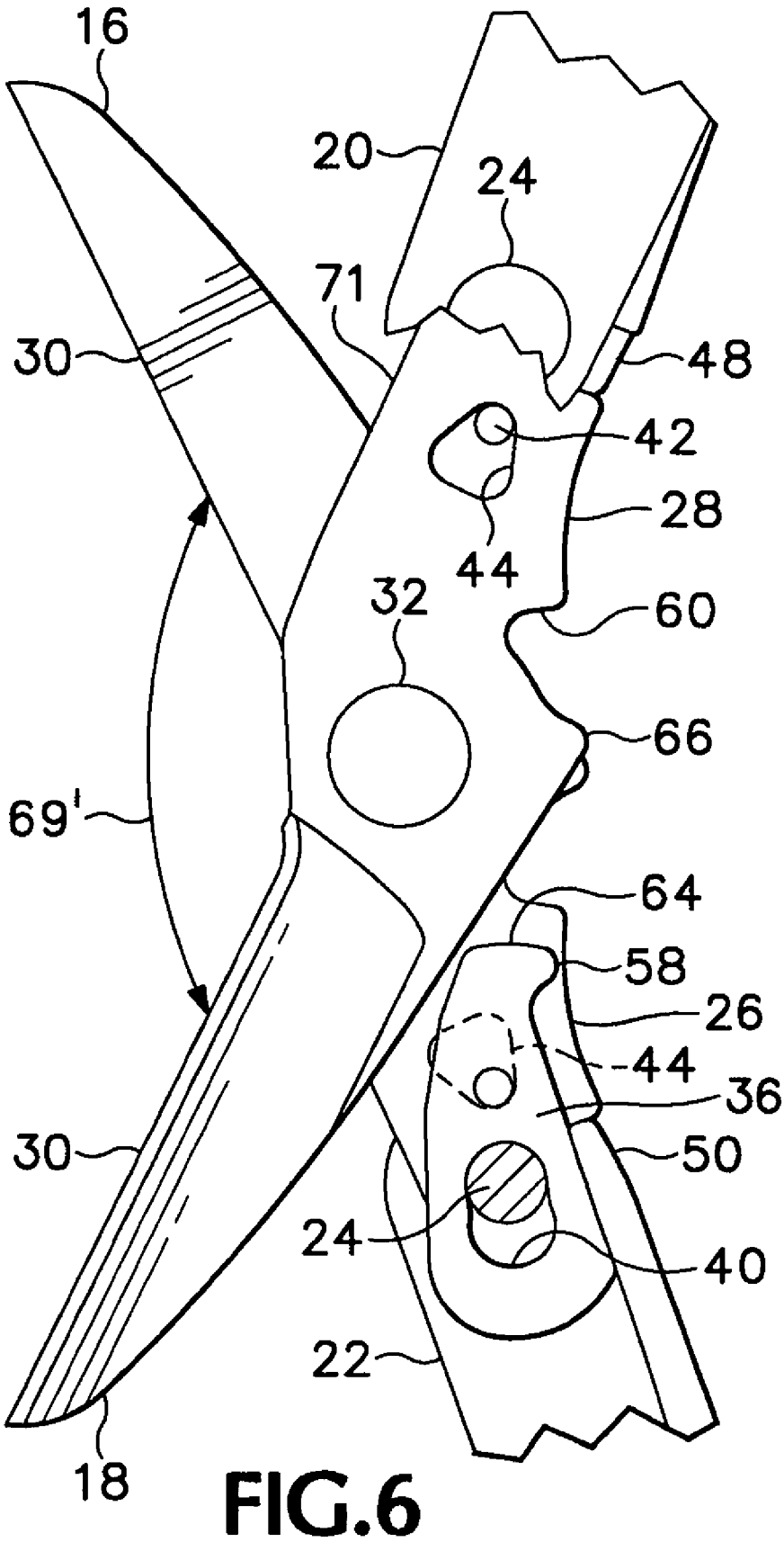
FIG. 6 is a view of the portion of a tool shown in FIGS. 4 and 5, showing the scissors opened for sharpening, with the rockers still in their rearward positions.

Because of the slot 40 in each rocker, each rocker 36 and 38 can be moved away from the scissors blade pivot 32, toward a second, or rearward, position of each rocker, when the handle 20 or 22 is in its extended position with respect to the adjacent blade base 26 or 28. A rocker can be moved rearward on the pin 24 by using a tool such as an appropriately small screwdriver 70, of which only the blade shown in FIG. 4, between the outer end 64 of each rocker 36 and 38 and the heel 66 of the opposite blade 16 or 18, as shown in FIG. 4. Both rockers 36 and 38, if present, must be moved to their rearward positions to permit the scissors blades to opened to a wider angle, as for sharpening of the cutting portions 30. With each rocker 36, 38 in its rearward position, the heel 66 of each scissors blade has enough clearance to move past the outer end 64 of the opposite rocker 36 or 38, as shown in FIG. 5, and the blades 16, 18 can be opened to a greater separation angle 69', preferably greater than 90 degrees, as shown in FIG. 6, limited by the shapes of the rockers and the backs of the scissors blades 16 and 18. The greater separation angle 69' provides increased clearance, facilitating sharpening of the scissors or cleaning or repairing surfaces of jaws or jawlike elements.

In a preferred embodiment of the folding scissors 14, merely moving the handles 20, 22 back toward each other in a blade-closing direction, as in a cutting stroke of the scissors, returns the rockers 36 and 38 to their forward, or normal operational positions. The tip 58 of each rocker 36 or 38 is brought into contact with the opposite blade base 26 or 28 as shown in FIG. 7, in a position on the margin of the scissors blade base that does not obstruct and that preferably will assist in moving the rocker 36 or 38 forward toward its normal position with respect to the pivot pin 24 extending through the slot 40.

Figure 7:
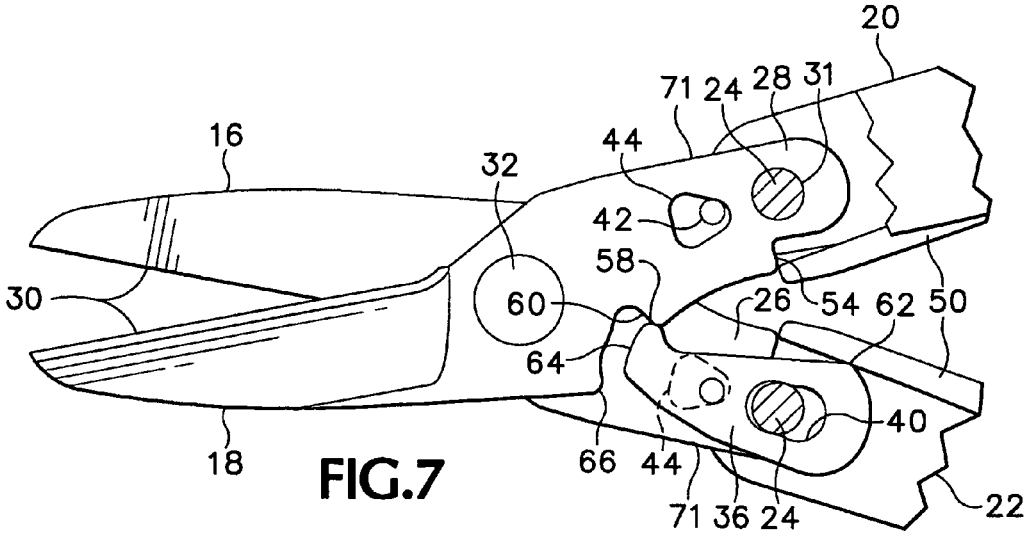
FIG. 7 is a detail view of the tool shown in FIGS. 1–6, showing the blades, rockers, and rocker springs, but omitting the blade springs, with the rockers in their retracted positions at the commencement of a blade-closing stroke.
Figure 8:
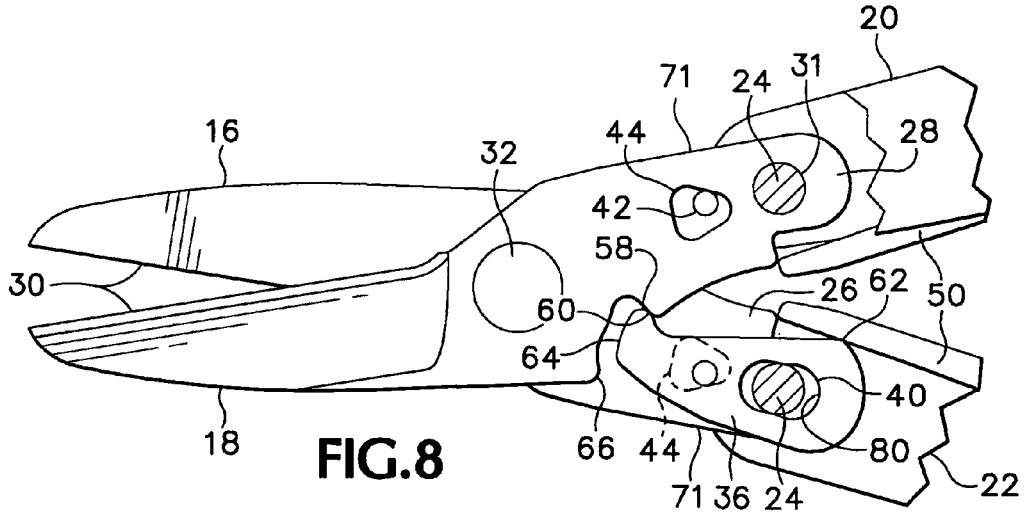
FIG. 8 is a view similar to FIG. 7, showing the blades moved further toward a closed position, with a rocker engaged by a blade, and showing the resulting movement of the rocker toward its normal, forward, position.

Referring also to FIG. 8, it is important for such self-repositioning of the rockers 36 and 38 that the pin 42 of each rocker, as shown in FIG. 7, have room within the aperture 44 in the adjacent blade base to move toward the outside margin 71 of the base of the scissors blade as the handles 20 and 22 are squeezed toward each other in resetting the rockers to their forward, normal working positions.

As the handles 20, 22 are squeezed together the tip 58 of each rocker is moved by the blade base 26 or 28 with which it is in contact, causing the rocker to rotate around the handle pivot pin 24 and, by reaction, to flex the respective rocker spring 50. This movement of the rocker brings the pin 42 into contact with the interior surface of the aperture 44 into which it projects. The interior surface of the aperture 44 acts as a cam followed by the pin 42 and thus urges the rocker toward its first, or forward, normal operating, position, as the pin 42 moves toward the outer side 71 of the scissors blade defining the aperture.

Figure 9:
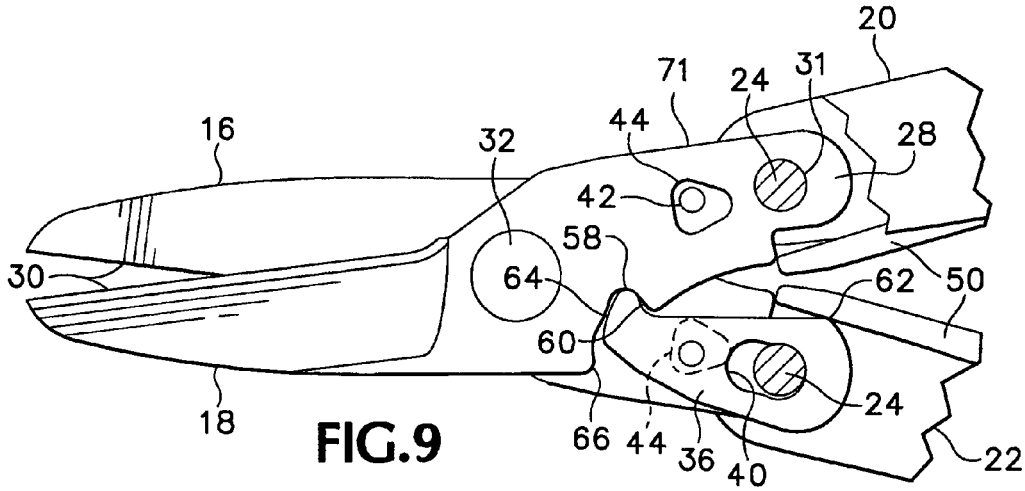
FIG. 9 is a view similar to FIGS. 7 and 8, showing the blades of the scissors nearly fully closed and the rockers returned to their forward, or normal operational, positions.

Additionally, the shape of the cam portion 60 of the blade base is designed to cooperate with the surface of the rocker tip 58 so that the rocker tip 58 can slide forward along the cam portion 60 of the blade base. The angle at which the rocker spring encounters the cam lobe 62 of the rocker preferably also produces a net force urging the rocker forward, toward its forward or normal operational position with respect to the blade base 26, 28 and the associated handle pivot pin 24. As a result, as the scissors blades 16 and 18 approach being fully closed, the rocker 36 or 38 is urged forward, returning fully into its forward, or normal, position, as shown in FIG. 9.

Figure 10:
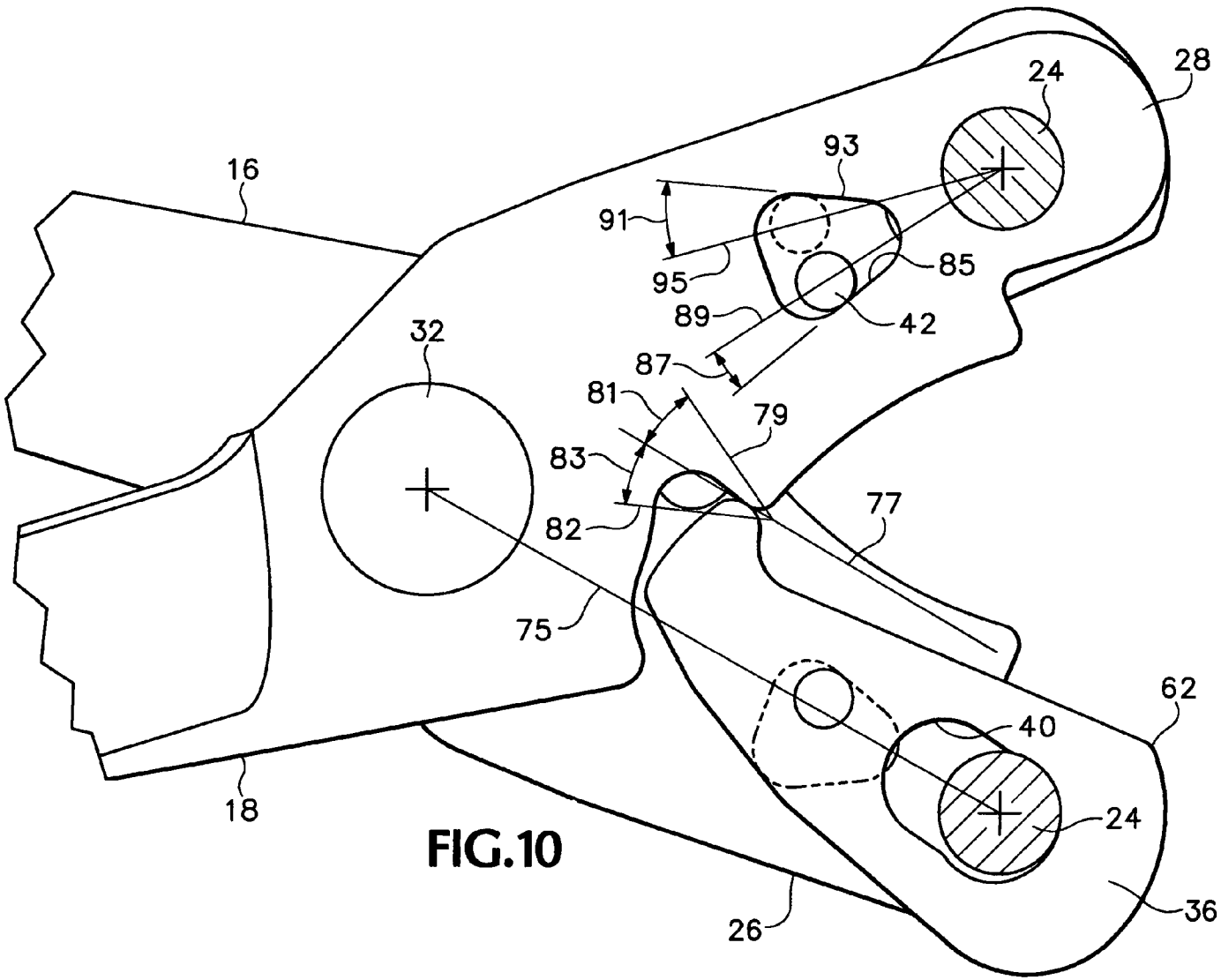
FIG. 10 is a detail view at an enlarged scale, showing a portion of the tool shown in FIG. 1.

Referring to FIG. 10, certain angular relationships among the surfaces of the blades or jaw-like tool elements, the rockers, and the openings in the blade bases 28 and 26 are desirable in order to avoid having the rockers 36 and 38 move unintendedly from their usual forward positions toward their rearward positions. Certain angular relationships are also important to the automatic return of each rocker 36 or 38 to its forward position with respect to its pivot pin 24 in response to movement of the blades in a blade-closing direction as described above.

An imaginary line 75 extends between the axis of rotation of the blade pivot joint 32 and the central axis of the pivot pin 24, which coincides with the axis of rotation of the rocker 36 or 38 mounted on the pin 24. An imaginary line 77 is parallel with the line 75, and the shapes of the tip 58 of each rocker and of the cam surface 60 of the blade or other jaw-like element should be such that the locus of the moving point of contact between the tip 58 and the cam surface 60 lies no closer to the line 75 than along the line 77 or an extension of that line as the handles are moved in a blade-closing direction, in order not to have a camming action urging the rocker 36 or 38 in a rearward direction with respect to the pivot pin 24. Preferably, the locus of the point of contact between the tip 58 and the cam surface 60 lies along the line 79 diverging away from the line 75 by an angle 81. As the angle 81 increases, the tendency for the rocker 36 of 38 to be moved rearwardly as a result of operation of the tool 14 decreases. On the other hand, if the locus of the points of contact between the tip 58 and the cam surface 60 lies along a line 82 converging toward the line 75, there is an undesirable tendency for cam action of the surface 60 on the tip 58 to urge the rocker 36 or 38 rearwardly toward the pivot pin 24. That tendency increases with the increase in size of the angle 83 between the line 82 and the line 77.

The relationship between the pin 42 and the interior surface 85 of the opening 44 in the blade base has an effect on the tendency of folding the handles 20 and 22 of the tool to move the rockers 36 and 38 rearwardly toward the pins 24. The surface 85 of the inside of the opening 44 defines an angle 87 which could be close to 0° and still be of some benefit, but preferably is larger and at least about 7° with an imaginary line 89 interconnecting the central axis of the pivot pin 24 with the central axis of the projecting pin 42, as shown in FIG. 10, in order that opening the blades to the maximum blade separation angle 69 does not result in the surface 85 acting as a cam to urge the projecting pin 42 rearwardly toward the pivot pin 24 if the handles are separated further.

In order that the action of pivoting the handles 20 and 22 respectively about the bases 26 and 28 of the blades to unfold the handles does not urge the rockers 36 and 38 rearwardly from their normal forward positions toward the handle pivot pins 24, the angle 91 between an interior surface 93 of the opening and an imaginary line 95 interconnecting the central axis of the handle pivot pin 24 with the central axis of the projecting pin 42 when that pin is in contact with the surface 93 should be as large as possible, and preferably at least about 20.50 in the tool 14 shown herein.

In another preferred embodiment of the tool 14, the pin 42 may have three intersecting convexly arcuate sides rather than being of a circular cylindrical shape, and the opening 44 may be circular. This combination provides a pin that still fits with enough freedom of movement in the required directions within the opening 44 to accommodate necessary angular motion of the rocker 36 or 38 and movement between its normal and retracted positions. The shape also helps the pin 42 follow such a circular surface defining the opening 44 in restoring the rocker to its forward position.

Figure 11:
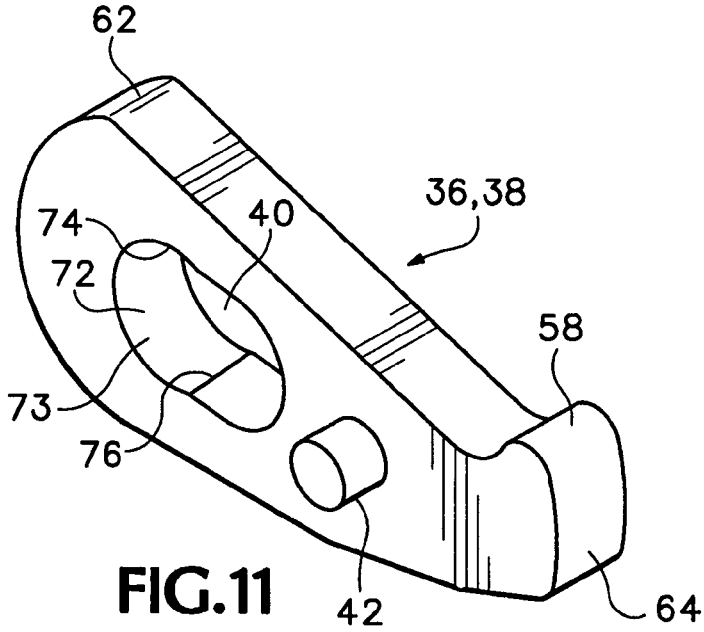
FIG. 11 is an isometric view of one of the rockers, at an enlarged scale.
Figure 12:
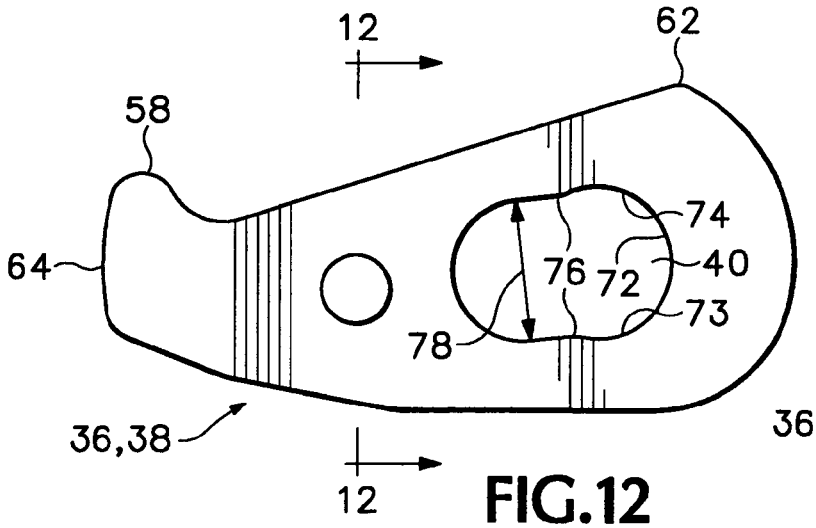
FIG. 12 is a side elevational view of the rocker shown in FIG. 11.
Figure 13:
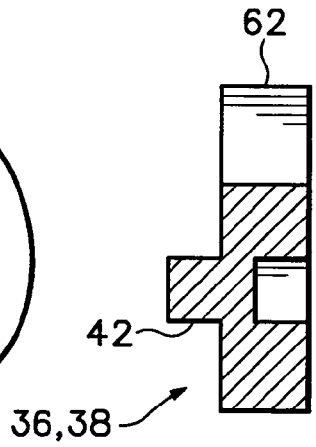
FIG. 13 is a sectional view taken along line 13—13 of FIG. 12.

While it is critical that the slot 40 be long enough to permit the rocker to be moved rearward far enough to provide clearance for the blade to pass by the outer end 64 of the rocker, in one preferred embodiment of the rocker, shown in FIGS. 10–12, the slot 40 is also widened slightly at its rear end 72, to form a pair of shallow arcuate indentations, or saddles, 73 and 74 to resist unintended movement of the rockers 36 and 38 with respect to the pivot pins 24. The saddle 74 engages the handle pivot pin 24 when the associated handle 20 or 22 is fully extended, and the saddle 73 engages the handle pivot pin 24 when the associated handle is fully folded, as a result of the respective rocker spring 50 urging the rocker toward the pin 24 when the rocker 36 or 38 is in its first, or forward position and the respective handle 20 or 22 is in or near either its fully extended or its folded position. The saddles 73 and 74 may be provided by forming the rear end of the slot 40 to have a slightly larger radius than the pivot pin, while the front end of the slot 40, near the outer end 64 of the rocker, is slightly narrower than the rear end, having a width 78 barely greater than the diameter of the handle pivot pin 24. A pair of opposite shoulders 76, which resist movement of the rocker 36 or 38 from its normal operational position to its retracted position, are present between the front and rear ends of the slot 40. Since the rocker spring 50 presses the rocker 36 or 38 toward the handle pivot pin 24, during movement of the rocker 36 or 38 toward its second or rearward position, the shoulder 76 adjacent the pivot pin 24 acts as a wedge, and movement of the pivot pin 24 onto the shoulder 76 requires the rocker spring 50 to be forced further away from the handle pivot pin 24 as the rocker 36 or 38 moves along the rocker spring 50.

When the rocker is being moved in the opposite direction, from its rearward position back to its forward, or normal operational position, the rocker spring 50 flexes elastically back toward the handle pivot pin 24 as the rocker 36 or 38 moves toward its normal position. The slope of the shoulder 76 then helps to urge the rocker back to the normal position at the rear end 72 of the slot 40, where the handle pivot pin can again rest in the saddle 74.

It will be understood that other shapes for the slot 40 would also function similarly to make the rocker more stable in its normal, operational, position than in its rearward position, at least when the handles are extended with respect to the blades.

While the folding tool 14 shown herein includes the handles 20 and 22 which can be moved about the handle pivot pins 24 as mentioned above, a tool incorporating rockers 36 and 38 need not include handles that are able to fold with respect to the base 26 or 28 of the blade, so long as there is an appropriate pivot pin on each handle properly located with respect to the blade pivot 32.

The terms and expressions that have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims that follow.

The invention claimed is:

1. A scissors-action hand tool, comprising:

(a) first and second tool elements, each of said tool elements having a base and a working portion, and said tool elements being interconnected by a pivot joint located between said base and said working portion of each said tool element, providing for scissors-action movement of the tool elements with respect to each other between a closed position and a position defining a separation angle;

(b) a pair of handles, a respective one of said handles being interconnected with each of said bases;

(c) a spring associated with one of said handles, said spring being arranged to urge said tool elements in an opening direction with respect to each other; and (d) a limit stop associated with said base of said first tool element and moveable, between a first location with respect to said base, in which said limit stop permits movement of said tool elements in said opening direction to, but not beyond a first separation angle, and a second location with respect to said base, in which there is additional clearance between said limit stop and said second tool element to permit said tool elements to be moved in said opening direction to a larger second separation angle providing greater clearance around said working portions.

2. The tool of claim 1 wherein said tool elements are scissors blades and said larger second separation angle provides increased clearance for sharpening said scissors blades.

3. The tool of claim 1 wherein said limit stop is a rocker carried on said base of said first tool element, said rocker interfering with said second tool element when said tool elements are moved in said opening direction to said first separation angle when said rocker is in said first location, thereby preventing said first and second tool elements from opening beyond said first separation angle, and said rocker being located clear of said second tool element when said tool elements are at said first separation angle and said rocker is in said second location, allowing said tool elements to be opened apart from each other to said larger second angle.

4. The tool of claim 3 wherein said first location of said rocker is a forward position closer to said working portion of said first tool element and said second location of said rocker is a rearward position farther away from said working portion of said first tool element.

5. The tool of claim 3 wherein said first and second tool elements are respective first and second scissors blades and said working portion of each said blade is a cutting portion.

6. The tool of claim 3 wherein said spring presses on said rocker, thereby urging said rocker into contact with said base of said second tool element and thereby urging said tool elements apart from each other in said opening direction when said rocker is in said first location and said tool elements are closer together than said first separation angle.

7. The tool of claim 3, wherein each one of said pair of handles is movable about a respective handle pivot between an extended position and a folded position with respect to the base with which it is interconnected.

8. The tool of claim 7 wherein said spring presses on said rocker, thereby urging said rocker into contact with said base of said second tool element and thereby urging said tool elements apart from each other in said opening direction when said handles are in their respective extended positions and said tool elements are closer together than said first separation angle.

9. The tool of claim 3 wherein one of said pair of handles is foldable with respect to said base of said first tool element.

10. The tool of claim 3 including a second said rocker, said second rocker being carried on said base of said second tool element, and said second rocker being movable with respect to said base of said second tool element between a first location, in which said second rocker blocks said first tool element when said tool elements are moved in said opening direction to said first separation angle, and a second location, said second rocker being clear of said first tool element when said second rocker is in said second location, and wherein said tool elements can be opened apart from each other to said second separation angle when both said rocker and said second rocker are in their respective second locations.

11. The tool of claim 10 including a second spring carried on the one of said pair of handles attached to said base of said second tool element, and wherein each of said spring and said second spring presses on a respective one of said rockers urging said rocker and said second rocker into contact respectively against said second and first tool elements and thereby urging said tool elements apart, when said rocker and said second rocker are in their respective first locations.

12. The tool of claim 3 wherein said second separation angle is at least about 90 degrees.

13. The tool of claim 3 wherein said rocker is free to pivot through only a limited angle with respect to said base of said first tool element when said rocker is in said first location, said limited angle keeping said rocker in such a position with respect to said base that said rocker obstructs said second tool element and thereby prevents said tool elements from moving in said opening direction beyond said first separation angle.

14. A scissors-action subassembly for a folding multipurpose tool, comprising:

(a) first and second tool elements, each of said tool elements having a tool element base and a working portion;

(b) a pivot joint located between said base and said working portion of each said tool element, said pivot joint interconnecting said tool elements and providing for scissors action movement of the tool elements with respect to each other;

(c) a pair of handles, a respective one of said handles being interconnected with each of said bases; and (d) a spring-biased tool element opening and limiting member located alongside said tool element base of said first tool element and moveable selectively with respect to said base, between a first, normal, location with respect to said pivot joint and said base of said first tool element, in which said tool element opening and limiting member urges said tool elements apart from a closed condition but blocks said second tool element and thereby prevents said tool elements from opening beyond a first predetermined maximum separation angle during use of said scissors-action subassembly, and a second, rearward, location with respect to said base of said first tool element and further than said first, normal, location from said pivot joint, in which said opening and limiting member provides clearance for said second tool element to move in an opening direction to a second separation angle that is greater than said first predetermined maximum separation angle.

15. The subassembly of claim 14 wherein moving said handles toward each other in a closing direction of said tool elements when said tool element opening and limiting member is in said second location causes said tool element opening and limiting member to move with respect to said base of said first tool element to said first location.

16. The subassembly of claim 14 wherein said tool element opening and limiting member is a rocker mounted on a rocker pivot located in a predetermined location with respect to said base of said first tool element.

17. The subassembly of claim 16 wherein said interconnected with said base of said first tool element handle includes a spring arranged to urge said rocker to rotate about said rocker pivot in an opening direction, and wherein said rocker is free to pivot through no more than a predetermined angle with respect to said base and wherein an outer end of said rocker blocks said second tool element when said rocker is located in said first, normal, location with respect to said base of said first tool element, and wherein said outer end of said rocker is clear of said second tool element when said rocker is in said second location.

18. The subassembly of claim 16 wherein said rocker pivot includes a pivot pin located in said predetermined position with respect to said base of said handle interconnected with said base of said first tool element and an elongated pivot hole defined in said rocker, said pivot pin being located in a first part of said elongated pivot hole when said rocker is in said first location, and said pivot pin being located in a second part of said elongated pivot hole when said rocker is in said second location.

19. The subassembly of claim 18 wherein said handle interconnected with said base of said first tool element includes a spring pressing on said rocker and thereby urging an interior surface of said elongated pivot hole into contact against said pivot pin.

20. The subassembly of claim 19 wherein said interior surface of said elongated pivot hole defines a saddle and wherein said pivot pin is located in said saddle when said rocker is in said first location.

21. A scissors-action hand tool, comprising:

(a) first and second tool elements, each of said tool elements having a base and a working portion, and said tool elements being interconnected by a pivot joint located between said base and said working portion of each said tool element, providing for scissors-action movement of the tool elements with respect to each other;

(b) a pair of handles, a respective one of said handles being interconnected with each of said bases;

(c) a spring associated with one of said handles, said spring being arranged to urge said tool elements in an opening direction with respect to each other; and (d) a limit stop associated with said base of said first tool element and moveable between a first position with respect to the base, in which said limit stop is rotatable through a limited angle with respect to said base and permits movement of said tool elements in said opening direction to, but not beyond a first separation angle, and a second position with respect to said base, in which the entire limit stop is farther from said pivot joint than when it is in said first position, said second position providing sufficient clearance between said limit stop and said second tool element to permit said tool elements to be moved in said opening direction to a larger second separation angle providing greater clearance around said working portions.

22. A scissors-action subassembly for a folding multipurpose tool, comprising:

(a) first and second tool elements, each of said tool elements having a tool element base and a working portion, and said tool elements being interconnected by a pivot joint located between said base and said-working portion of each said tool element, providing for scissors action movement of the tool elements with respect to each other;

(b) a pair of handles, a respective one of said handles being interconnected with each of said bases;

(c) a spring-biased tool element opening and limiting member located alongside said tool element base of said first tool element and moveable selectively with respect to said base, between a first, normal, position in which said tool element opening and limiting member urges said tool elements apart from a closed condition but blocks said second tool element and thereby limits said tool elements to a predetermined maximum separation angle during use of said scissors-action subassembly, and a second, rearward, position in which said opening and limiting member provides clearance for said second tool element to move in an opening direction to a second, larger separation angle, wherein said tool element opening and limiting member is a rocker mounted on a rocker pivot located in a predetermined position with respect to said base of said first tool element, and wherein said rocker pivot includes a pivot pin located in said predetermined position with respect to said base of said first handle and an elongated pivot hole defined in said rocker, said pivot pin being located in a first part of said elongated pivot hole when said rocker is in said first position, and said pivot pin being located in a second part of said elongated pivot hole when said rocker is in said second position.

23. The subassembly of claim 22 wherein said handle attached to said first tool element includes a spring pressing on said rocker and thereby urging an interior surface of said elongated pivot hole into contact against said pivot pin.

24. The subassembly of claim 23 wherein said interior surface of said elongated pivot hole defines a saddle and wherein said pivot pin is located in said saddle when said rocker is in said first position.

* * * * *